US005333959A

United States Patent [19]

Yamaguchi et al.

[11] Patent Number: 5,333,959

[45] Date of Patent: Aug. 2, 1994

[54] PRINTING DEVICE INCLUDING A CASSETTE ACCOMMODATION CHAMBER FOR ACCOMMODATING CASSETTES OF DIFFERENT THICKNESSES

[75] Inventors: Koshiro Yamaguchi, Kasugai; Yoshiaki Nagao, deceased, late of Tsushima; Sumiko Nagao, Administrator, Nagano, all of Japan

[73] Assignee: Brother Kogyo Kabushiki Kaisha, Aichi, Japan

[21] Appl. No.: 1,176

[22] Filed: Jan. 7, 1993

[30] Foreign Application Priority Data

Jan. 8, 1992 [JP] Japan ..... 4-020582

[51] Int. Cl.[5] ..... B41J 35/28

[52] U.S. Cl. ..... 400/208; 400/613

[58] Field of Search ..... 400/208, 211, 212, 216.1, 400/217, 217.1, 227.1, 227.2, 613, 613.1, 613.2, 615

[56] References Cited

U.S. PATENT DOCUMENTS 4,944,618 7/1990 Ideta ..... 400/211

5,168,814 12/1992 Kuzuya et al. ..... 400/636 X

FOREIGN PATENT DOCUMENTS 0312402 4/1989 European Pat. Off. .

0322918 7/1989 European Pat. Off. .

OTHER PUBLICATIONS

Patent Abstract of Japan, vol. 13 No. 209 (P-871), 1989 JP1025334 (Matsushita Electric Ind. Co.).

Patent Abstract of Japan, vol. 12, No. 199 (P-714) 1988 JP63000855 (Ricoh Co. Ltd.).

*Primary Examiner*—Edgar S. Burr

*Assistant Examiner*—Christopher A. Bennett

*Attorney, Agent, or Firm*—Kane, Dalsimer, Sullivan, Kurucz, Levy, Eisele and Richard

[57] ABSTRACT

In a cassette accommodation chamber of a printing device, a cassette accommodating a tape-shaped member is detachably mounted. The cassette accommodation chamber has a bottom surface, and an entrance opening opposite to the bottom surface. In the accommodation chamber, cassette receiving members are provided for receiving the cassette in such a fashion that, if a relatively thin cassette which accommodating a relatively thin cassette in said accommodation chamber, the thin cassette is positioned away from the bottom surface of said accommodation chamber. Namely, the cassette is positioned such that the surface of the cassette is positioned at the substantially same position regardless of the thickness of the cassette.

13 Claims, 9 Drawing Sheets

PRINTING DEVICE INCLUDING A CASSETTE ACCOMMODATION CHAMBER FOR ACCOMMODATING CASSETTES OF DIFFERENT THICKNESSES

Background of the Invention

The present invention relates to a tape cassette mounting structure in a print device for printing images such as alphanumeric characters onto a tape-shaped recording medium accommodated in the tape cassette.

Conventionally, there is proposed a tape print device for creating a tape by printing reversed images of characters and the like on the backside of a transparent tape, and adhering a double-sided adhesive tape provided with a release paper to the transparent tape. Thus created tape is suitably used as an index and the like, and adhered to the backside of a video cassette and the like.

In this kind of printing device, the tape cassette is exchangeably mounted. Further, there are various types of tapes having various widths ranging from a narrow to wide one. If both narrow and wide tape cassettes can be used exchangingly in a single printing device, it becomes quite convenient.

For this purpose, if the cassette accommodation unit is deeply formed, either a wide tape cassette or a narrow tape cassette can be mounted.

However, in such a construction, a narrow tape cassette is mounted with being dropped into the bottom of the tape accommodation unit.

With this arrangement, when the narrow tape cassette is mounted, a print head passes through the tape cassette and projects upwardly with respect to the upper surface of the cassette, and thus a problem arises in that a user's hand may contact the print head and to stain the surface of the print head. Further, an opening must be defined to a narrow tape cassette so that the print head passes therethrough, and thus another problem arises in that the user's hand may touch an ink ribbon and tape through the opening to stain them.

SUMMARY OF THE INVENTION

It is therefore an object of the present invention to provide an improved tape cassette mounting structure in a printing device, by which either narrow tape or a wide tape cassette can be used, and even if the narrow tape cassette is mounted, the stain of a print head surface, and the like can be prevented.

For the above object, according to the present invention, there is provided a printing divide printing device formed with a cassette accommodation chamber in which a cassette accommodating a tape-shaped member is detachably mounted, said cassette accommodation chamber having a bottom surface and an entrance opening opposite to said bottom surface, said printing device being capable of using any one of a plurality of predetermined thicknesses of cassettes accommodating tape-shaped members having different widths, respectively, for printing, said printing device comprising:

cassette receiving means provided in said cassette accommodation chamber for receiving the cassette in such a fashion that, if a relatively thin cassette of said plurality of predetermined thicknesses of cassettes is mounted in said accommodation chamber, said thin cassette is positioned away from said bottom surface of said accommodation chamber.

According to another aspect of the invention, there is provided a printing device formed with a cassette accommodation chamber in which a cassette accommodating a tape-shaped member is detachably mounted, said cassette accommodation chamber having a bottom surface and an entrance opening opposite to said bottom surface, said printing device being capable of using any one of a plurality of predetermined thicknesses of cassettes accommodating tape-shaped members having different widths, respectively, for printing, said printing device comprising:

cassette receiving means provided in said cassette accommodation chamber for receiving the cassette in such a fashion that, whichever one of said plurality of predetermined thicknesses of cassettes is attached to said accommodation chamber, the surface of said cassette opposite to a surface confronting said bottom surface is positioned substantially at the same position.

According to still another aspect of the invention, there is provided a printing device formed with a cassette accommodation chamber in which a cassette accommodating a tape-shaped member is detachably mounted, said cassette accommodation chamber having a bottom surface and an entrance opening opposite to said bottom surface, said printing device being capable of using any one of a plurality of predetermined thicknesses of cassettes accommodating tape-shaped members having different widths, respectively, for printing, said printing device comprising:

a head member protruded from the bottom of said cassette accommodation chamber, a predetermined portion of said head member being to be located inside a cassette when it is attached to said accommodation chamber;

cassette receiving means provided in said cassette accommodation chamber for receiving the cassette in such a fashion that, whichever one of said plurality of predetermined thicknesses of cassettes is attached to said accommodation chamber, said predetermined portion of said head member remains underlying the surface opposite to a surface of said cassette facing said bottom surface.

DESCRIPTION OF THE ACCOMPANYING DRAWINGS

DESCRIPTION OF THE EMBODIMENTS

Figure 1:
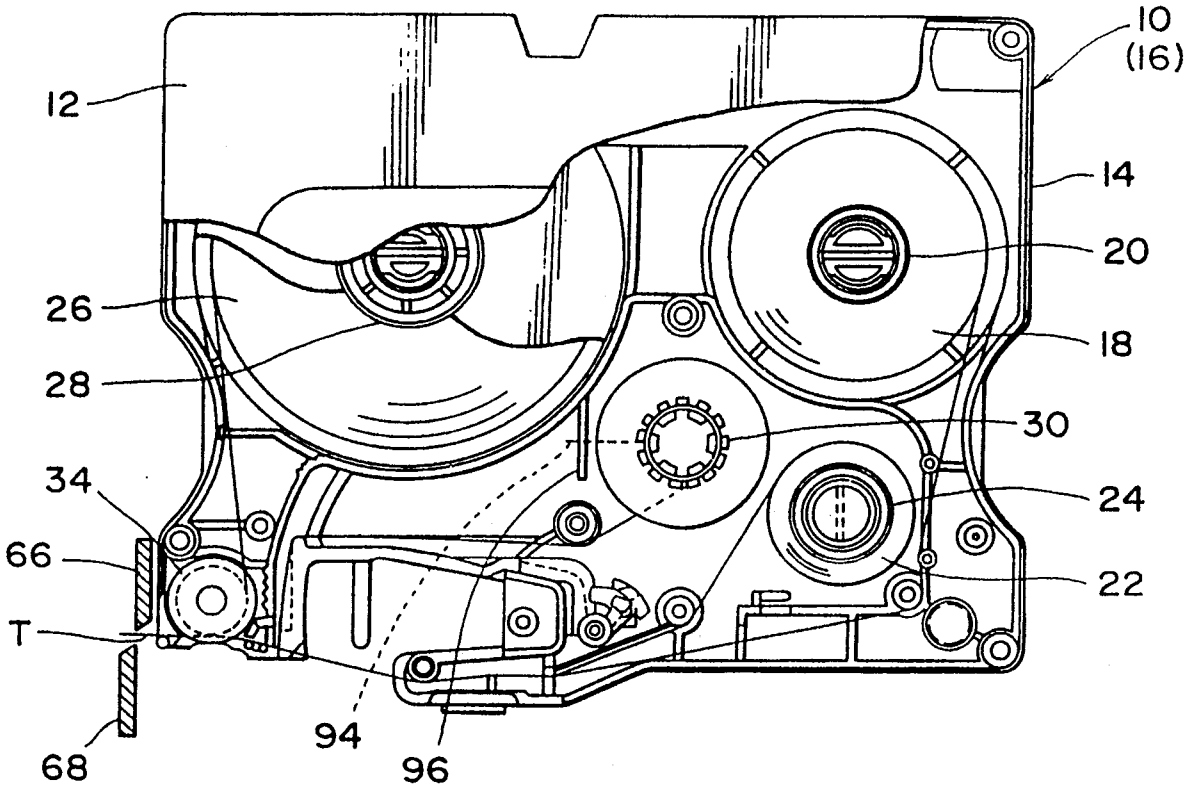
FIG. 1 is a plan view of a tape cassette to be used in a printing device embodying the present invention from which almost all the portion of an upper cover case is removed.

FIG. 1 shows the arrangement of a tape cassette 10 embodying the present invention.

The tape cassette 10 has a cassette case 16 composed of an upper cover member 12 and a lower case member 14 (in FIG. 1, almost all the portion of the upper cover member 12 is removed). Then, suitably and rotatably disposed in the cassette case 16 are:

a tape spool 20 around which a film tape 18 is wound;

a ribbon spool 24 around which an ink ribbon 22 is wound;

an adhesive tape spool 28 around which a double-sided adhesive tape with a release paper 26 being provided thereon such that the release paper side thereof faces to the outside; and a ribbon winding spool 30 for winding the ink ribbon 22 fed from the ribbon spool 24.

Further, a tape drive roller 34 is also rotatably disposed in the vicinity of a tape exit 32 opened at one side of the cassette case 16. The tape drive roller 34 feeds out a tape T, which is composed of the above film tape 18 adhered to the double-sided adhesive tape 26, from the tape exit 32 in association with a tape feed roller 62 provided with a printing device to be described later.

The tape cassette 10 can be one of a narrow tape cassette 10A and wide tape cassette 10B. The case of the narrow tape cassette 10A is formed to have a shallow bottom because the aforesaid film tape 18, ink ribbon 22 and double-sided adhesive tape 26 have a narrow width, while the case of the wide tape cassette is formed to have a deep bottom because these tapes and the like have a wide width.

Figure 9:
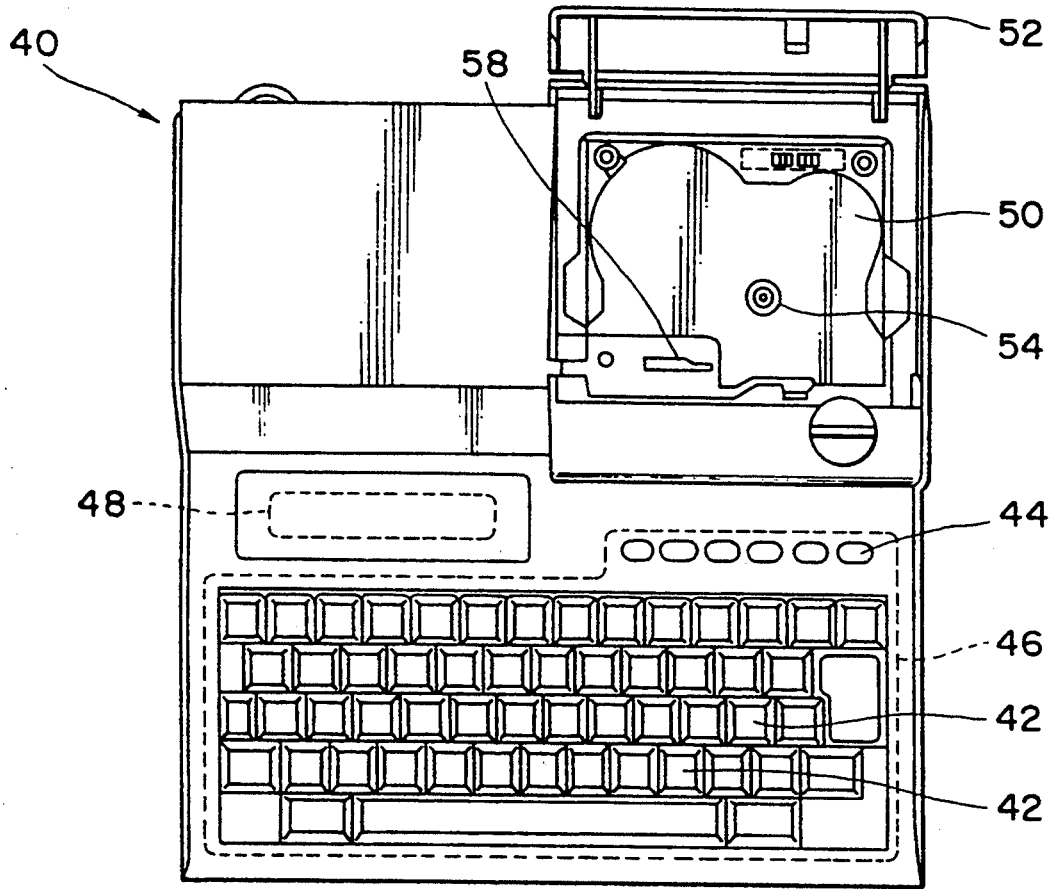
FIG. 9 is a plan view of the printing device according to the present invention.
Figure 10:
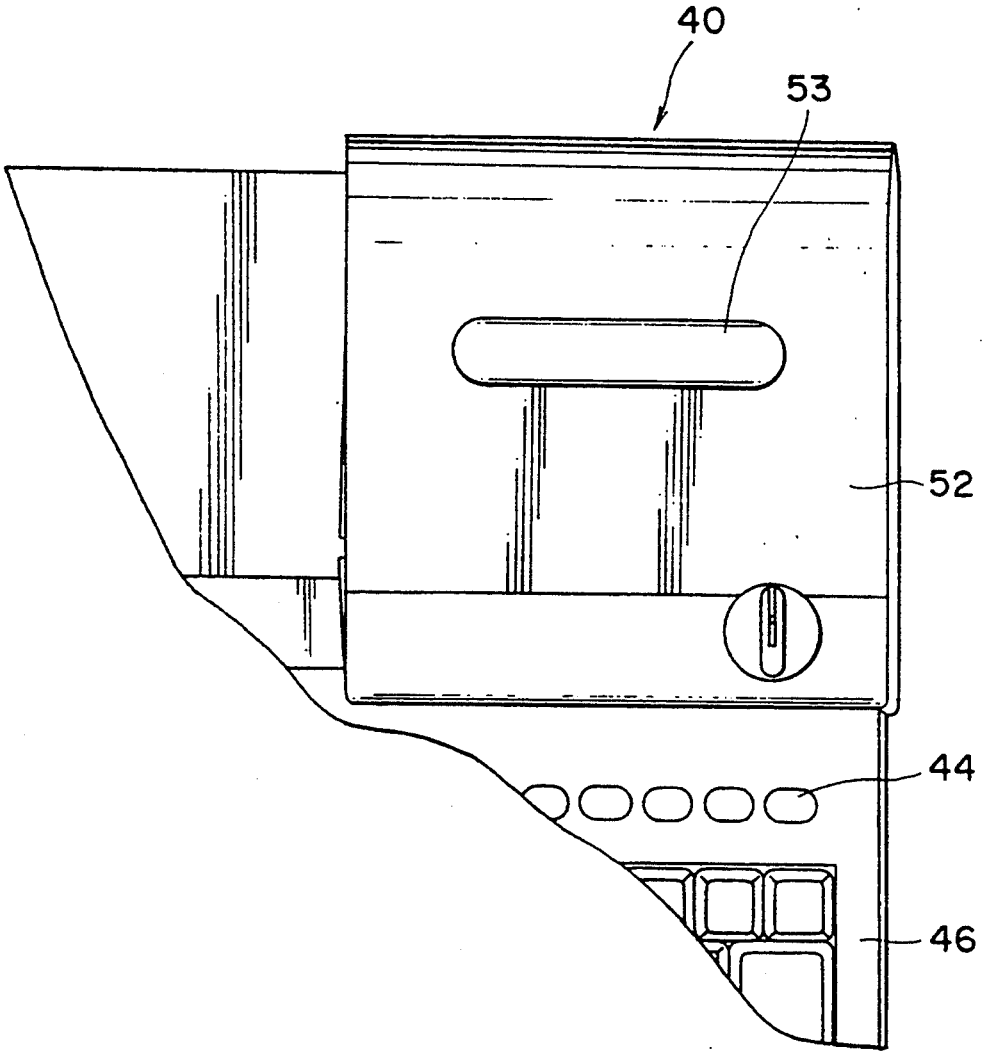
FIG. 10 is a plan view of the cassette accommodation unit in the printing device of FIG. 9 in the state that the cassette accommodation unit is covered with by a cassette cover.

The printing device which the tape cassette is to be coupled to is shown in FIGS. 9 and 10.

As shown in FIG. 9, in the printing device 40, provided are:

a character input key 42 for inputting characters and the like;

print key 44;

key board 46 on which various kinds of function key are provided;

liquid crystal display 48 for displaying characters and the like input through the key board 46; and a cassette accommodation unit 50 to which the tape cassette 10 is to be attached. An accommodation cover 52 is rotatably supported for covering an accommodation chamber of the tape cassette 10 at the rear portion of the printing device 40. The tape cassette 10 is attached/detached when the accommodation cover 52 is opened.

Further, a sight window 53 provided with a transparent plate is formed on the cassette cover 52. Through the sight window 53, a tape width, tape color, amount of remaining tape and the like of a tape cassette loaded in the cassette accommodation unit 50 are visually confirmed.

Figure 2:
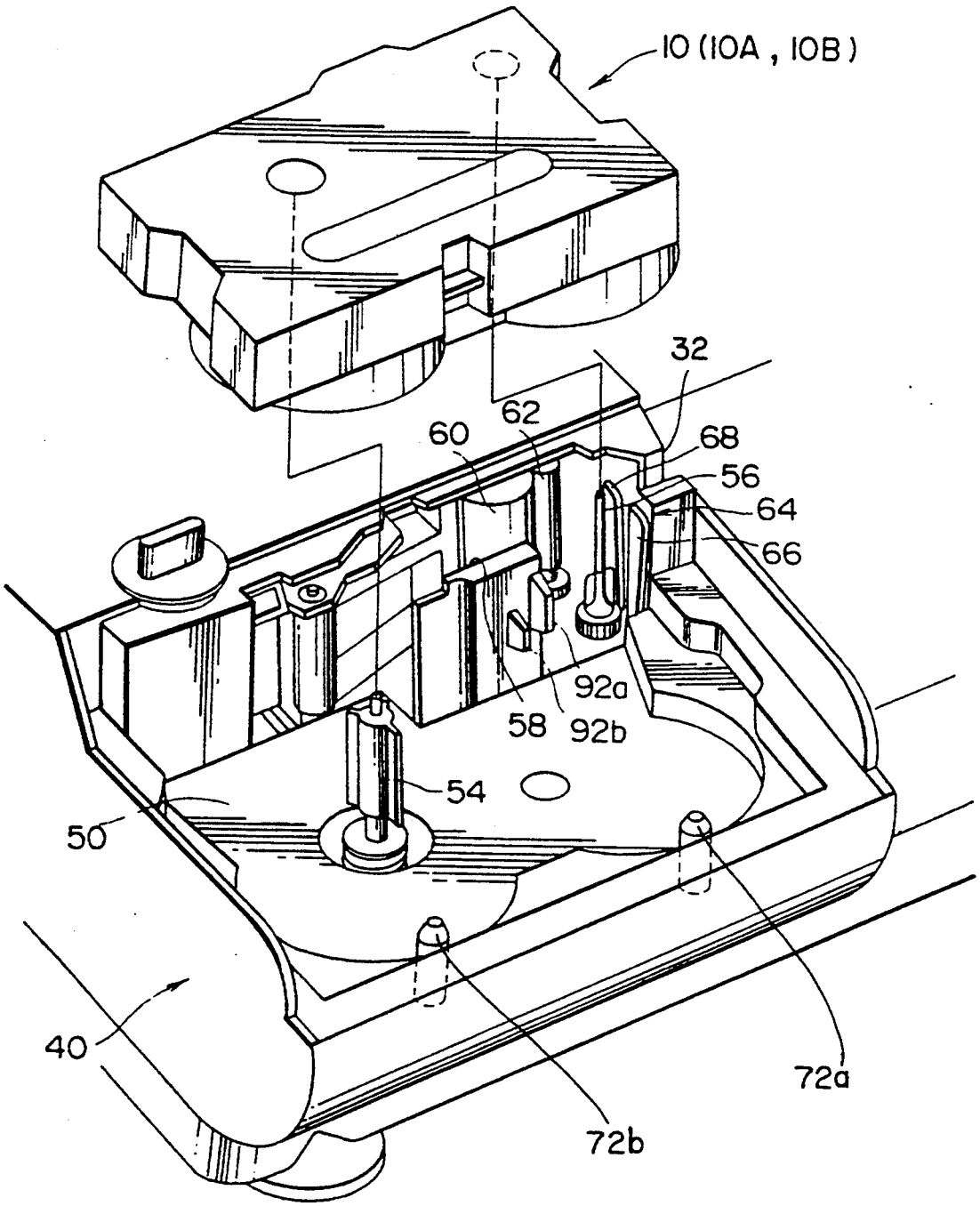
FIG. 2 is a perspective view of a cassette accommodation unit of the printing device of FIG. 1.

FIG. 2 schematically shows the cassette accommodation unit 50.

In the cassette accommodation unit 50, a ribbon winding shaft 54 is standingly disposed. The ribbon winding shaft 54 is driven by a pulse motor to rotate, and is engaged with the ribbon winding spool 30 of the tape cassette 10 to rotate the ribbon winding spool 30 in order to wind the ink ribbon 22. Further, a tape drive shaft 56 is also standingly disposed which is engaged with the tape drive roller 34, and rotates the same. The tape drive shaft 56 is engaged with a not shown motor through a not shown gear transmission mechanism.

A thermal print head 58 and platen roller 60 are standingly disposed in confrontation, and further the above tape feed roller 62 is disposed to feed the adhered tape T in association with the above tape drive roller 34. Although not described in detail, the platen roller 60 and feed roller 62 are supported by a roller holder and switched to a print position and release position by a not shown switch mechanism. This switch mechanism is described in detail in Japanese Patent Provisional Publication HEI 3-283814, and accordingly the description thereof is omitted here.

The above thermal print head 58 includes a plurality of heating elements for printing image such as characters and the like to the film tape 18 with use of the ink ribbon 22.

A tape cutter 64 is also disposed at a position adjacent to one side of the cassette accommodation unit 50 to cut the adhered tape T discharged from the tape exit 32 of the tape cassette 10.

The tape cutter 64 is composed of a fixed blade 66 and movable blade 68. The fixed blade 66 is fixedly arranged at a position adjacent to the tape exit 32, and the movable blade 68 is movably positioned at a position away from the tape exit 32.

Although not described in detail, the mechanism for driving the tape cutter 64 transmits the drive force of a motor to the movable blade 68 through a gear mechanism to move the movable blade 68 about its fulcrum. Thus, the adhered tape T is cut off by the closing operation of the movable blade 68 in association with the fixed blade 66.

With the above arrangement, step portions 70 are defined to the side wall surfaces of the above cassette accommodation unit 50. The step portions 70 receive the outer bottom surface of the narrow tape cassette 10A or the intermediate step portion of the wide tape cassette 10B, as shown in FIG. 2. Further, receiving pins **72*a*, 72*b* are standingly disposed on the inner bottom surface of the cassette accommodation unit 50 to receive the outer bottom surface of the narrow tape cassette 10A**.

Figure 3:
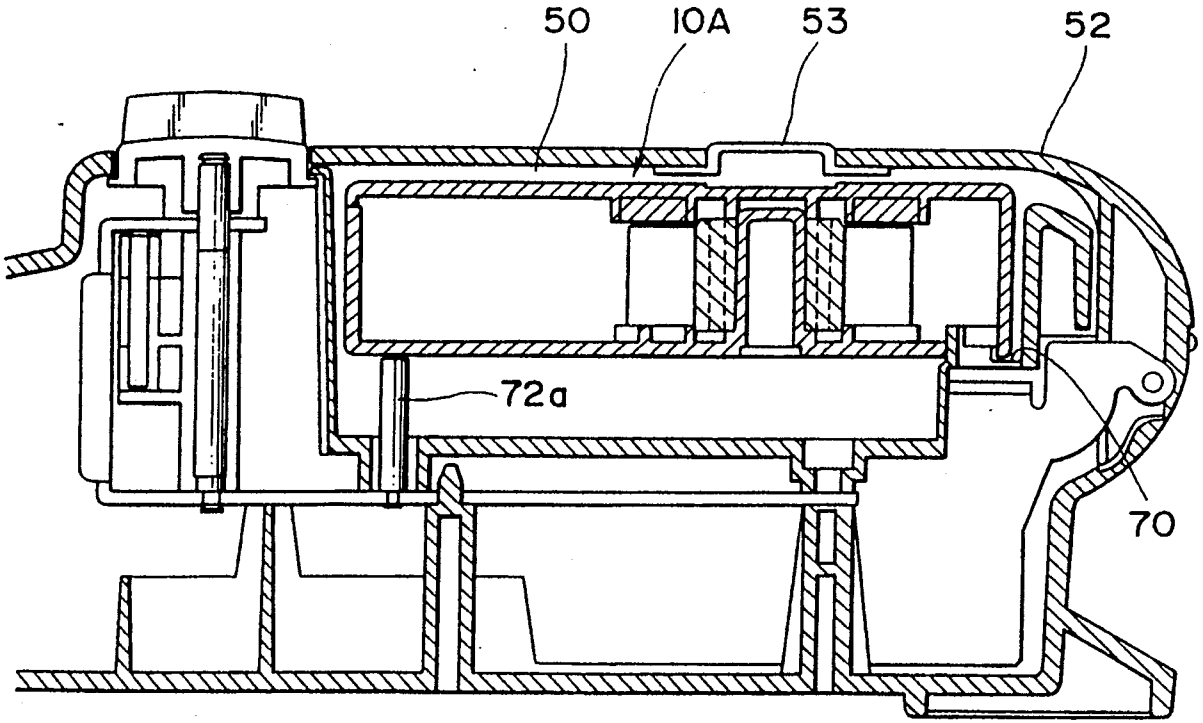
FIG. 3 is a cross sectional view showing a narrow tape cassette mounted to the cassette accommodation unit in the printing device.

Therefore, as shown in FIG. 3, when the narrow tape cassette 10A is attached to the cassette accommodation unit 50, it is horizontally supported on the upper side of the accommodation chamber of the cassette accommodation unit 50 by the step portion 70 and the receiving pins **72*a* and 72*b* in the accommodation chamber of the cassette accommodation unit 50**.

Consequently, the narrow tape cassette 10A is mounted to the opening on the outer side of the cassette accommodation unit 50 so that it can be easily attached/detached. Further, when the narrow tape cassette 10A is mounted, the ink ribbon 22 is prevented from being caught by a print head 58 and damaged, or the surface of the print head 58 is prevented form being stained.

Figure 4:
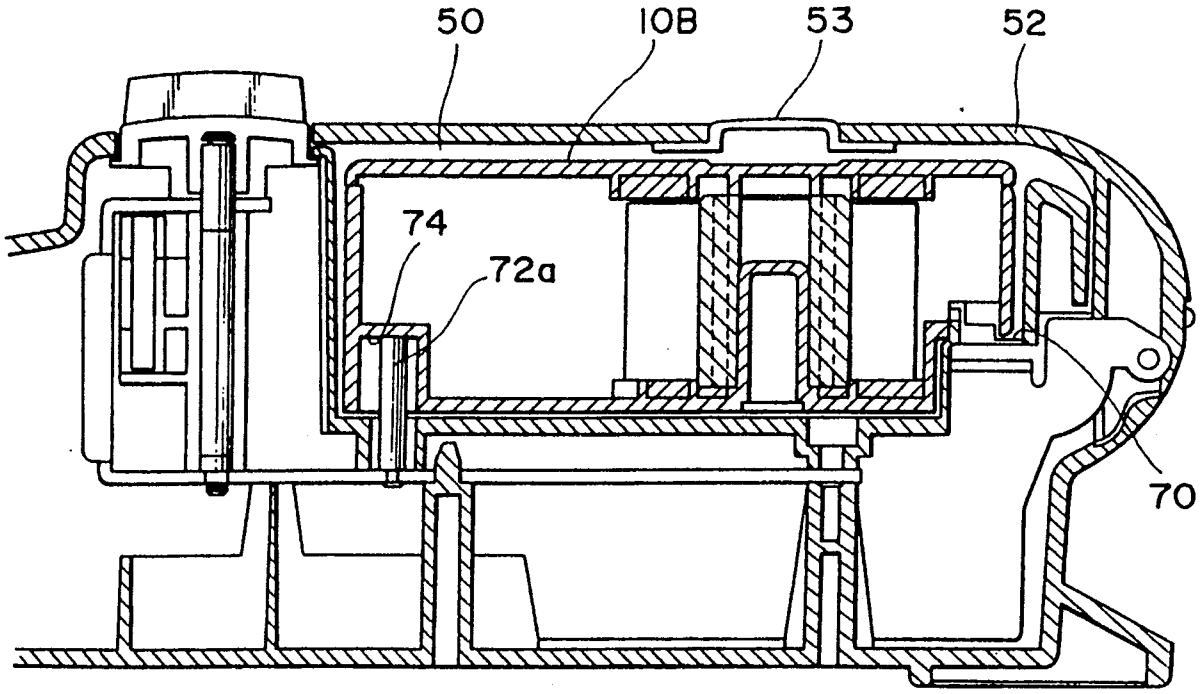
FIG. 4 is a cross sectional view showing a wide tape cassette mounted to the cassette accommodation unit in the printing device.

The outer bottom surface of the wide tape cassette 10B has recessed holes 74 to which the receiving pins 72a, 72b are fitted, as shown in FIG. 4. In this case, the top end of each of the receiving pins 72a, 72b is abutted against the inner bottom surface of the recessed hole 74, and thus the wide tape cassette 10B is received by these receiving pins 72a, 72b.

Figure 5:
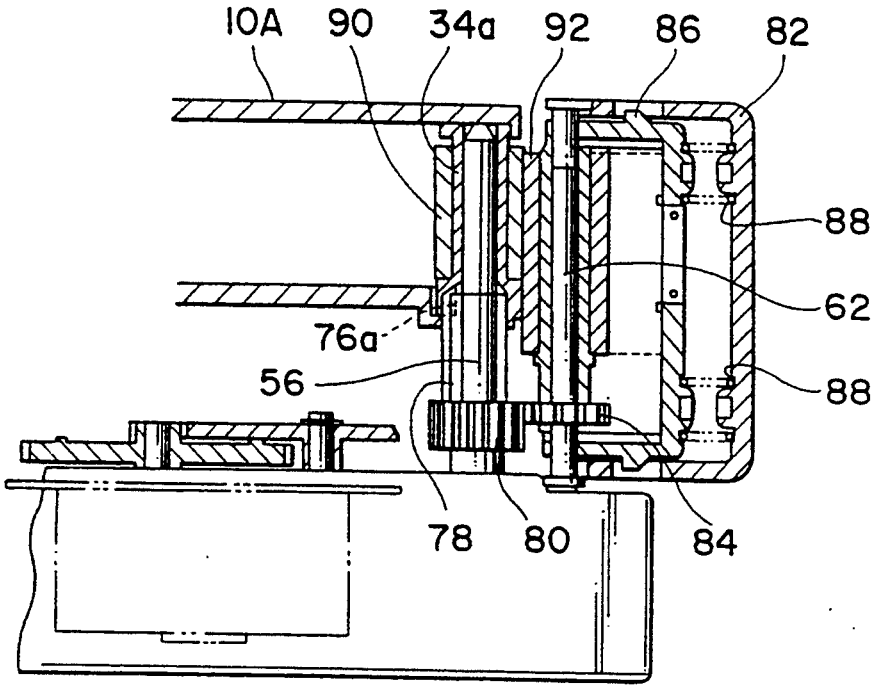
FIG. 5 is a cross sectional view of the engaging state of an adhered tape feed/drive unit in the state that a narrow tape cassette is mounted to the cassette accommodation unit.
Figure 6:
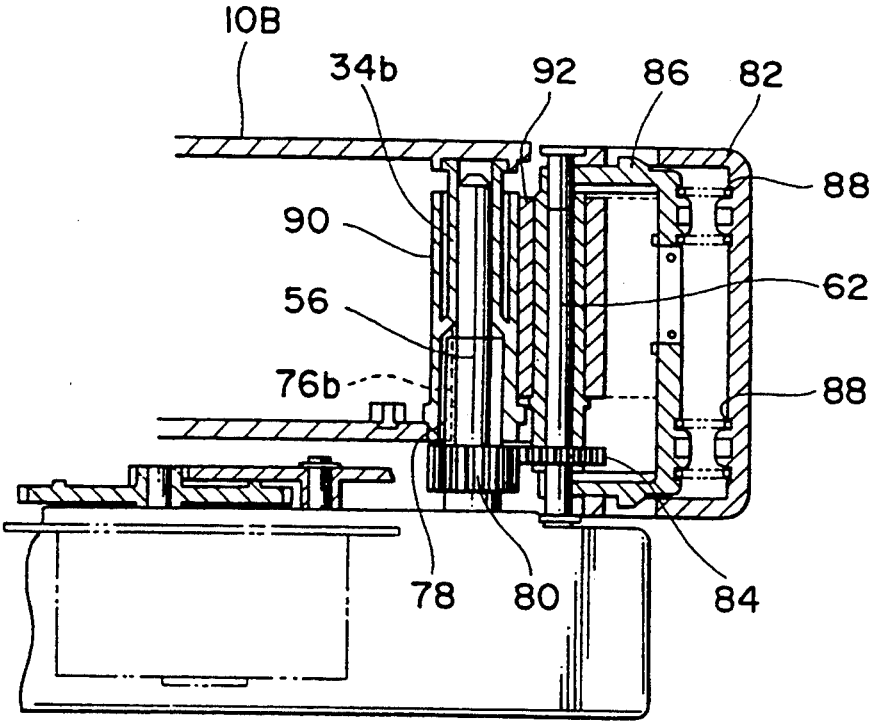
FIG. 6 is a cross sectional view explaining the engaging state of an adhered tape feed/drive unit in the state that a wide tape cassette is mounted to the cassette accommodation unit.

FIGS. 5 and 6 show the interior structrue of the tape cassette 10, i.e., the narrow tape cassette 10A or the wide tape cassette 10B. A roller cam 76a or 76b respectively provided on the inner circumference at the lower end of the tape drive roller 34a or 34b is engaged with a drive cam 78 disposed on the outer circumferencial surface of the tape drive shaft 56 of the above tape print device 40.

Further, in both the narrow tape cassette 10A and wide tape cassette 10B, a drive gear 80 disposed at the base end of the tape drive shaft 56 is engaged with a follower gear 84 provided at the base end of the tape feed roller 62 supported by the roller holder 82.

The tape feed roller 62 is pressed against the tape drive roller 34a or 34b in the tape cassette 10 (10A or 10B) through the roller presser 86 and springs 88 disposed to the roller holder 82. Thus, the adhered tape T is fed out as the drive gear 80 and follower gear 84 rotates in the state that it is pressedly held between the rubber roller 90 covering the tape drive roller 34a or 34b and the rubber roller 92 covering the tape feed roller 62.

Figure 7:
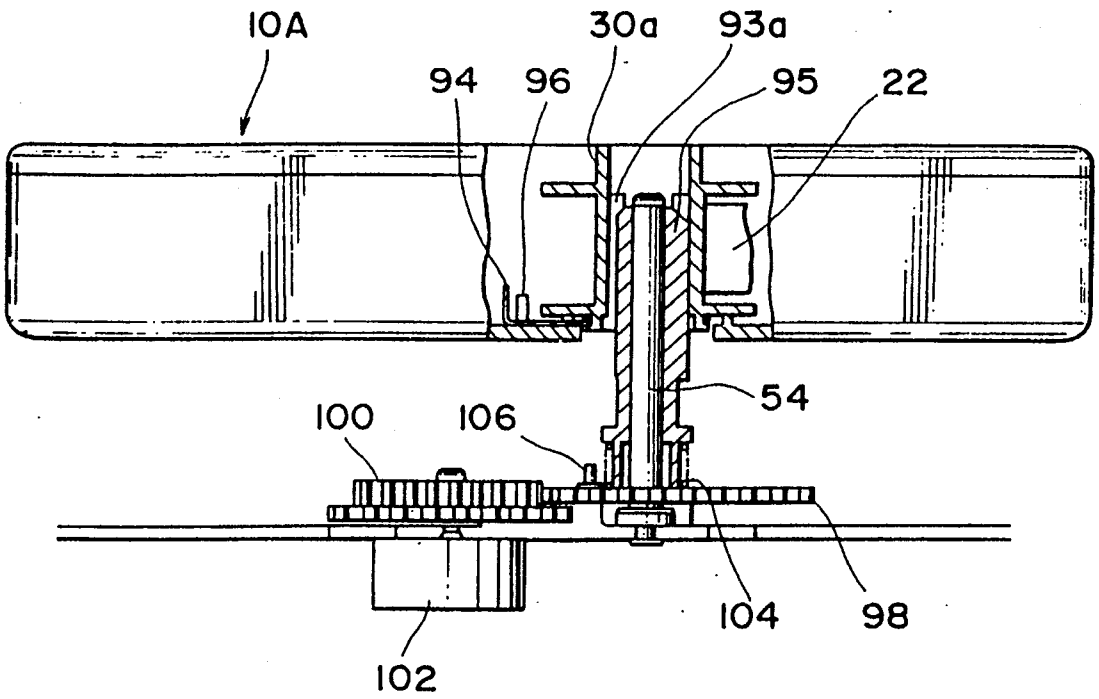
FIG. 7 is a cross sectional view illustrating the engaging state of an ink ribbon winding/drive unit in the state that a narrow tape cassette is mounted to the cassette accommodation unit.
Figure 8:
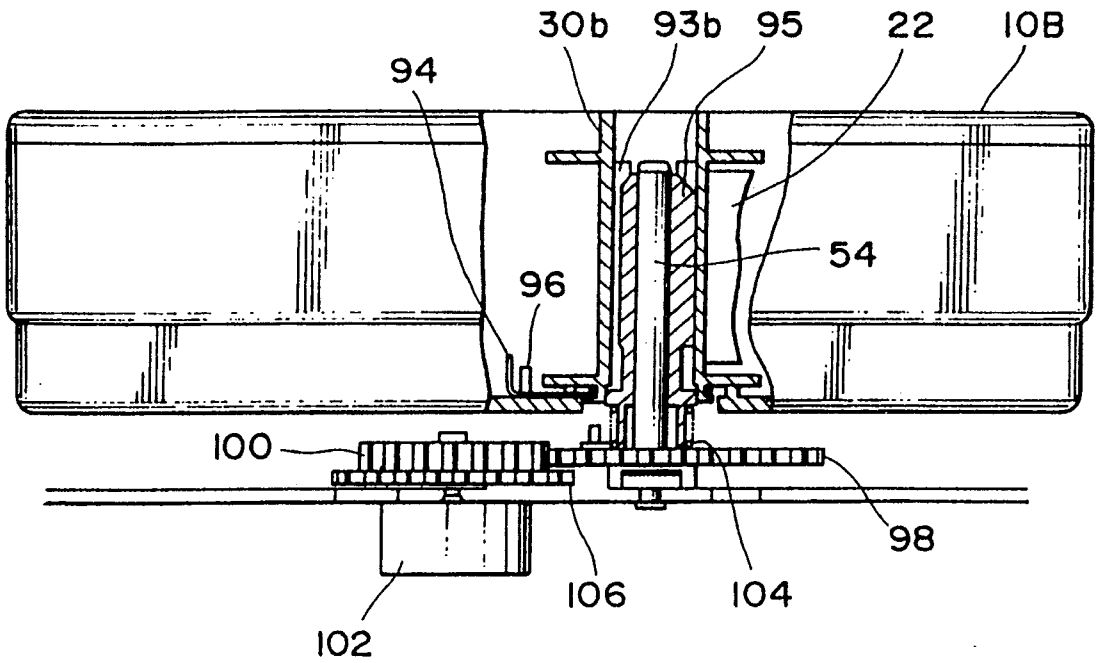
FIG. 8 is a cross sectional view explaining the engaging state of an ink ribbon winding/drive unit in the state that a wide tape cassette is mounted to the cassette accommodation unit.

Further, as shown in FIGS. 7 and 8, in both cases of the narrow tape cassette 10A and wide tape cassette 10B, the spool cam 93a or 93b provided on the inner circumferential surface of the ribbon spool 30a or 30b is engaged with the drive cam 95 provided on the outer circumferential surface of the ribbon winding shaft 54 of the tape printing device 40.

A ribbon drive gear 98 is loosely fitted to the outer circumference at the base portion of the ribbon winding shaft 54 and coupled with a motor 102 through a gear train 100.

clutch spring 104 is disposed around the outer circumferencial surface at the base portion of the ribbon winding shaft 54. The clutch spring 104 is composed of a coil slidably wound around the outer circumferencial surface at the base portion of the ribbon winding shaft 54 in the state that it is in pressed contact therewith, the other end of the coil being locked to the locking piece 106 disposed on the surface of the ribbon drive gear 98.

With this arrangement, a difference of speed between a given rotational speed of the ribbon drive gear 98 transmitted from the motor 102 and a rotational speed of the ribbon winding spool 30 which changes as a winding diameter of the ink ribbon 22 wound around the ribbon winding spool 30 changes is absorbed by slip caused between the ribbon winding shaft 54 and the clutch spring 104. Note, the ink ribbon 22 is wound by a frictional force between the clutch spring 104 and the winding shaft 54.

The ribbon winding shaft 54b is engaged with the spool cam 93b of the ribbon winding spool 30b over the entire length thereof, so is in the wide tape cassette 10B in FIG. 8.

Note, in both the narrow tape cassette 10A and wide tape cassette 10B, a spool spring 94 is provided to the ribbon winding spool 30a or 30b, respectively, and an end of the spool spring 94 is locked to the locking piece 96 on the lower cover case 14.

Frictional torque is produced from the printing device through the clutch spring 104, a required torque varies depending upon a width of the ink ribbon 22. A small torque is insufficient to wind the ink ribbon 22, but, when a torque is too large, the ink ribbon 22 may be cut off. In the embodiments, the frictional force produced through the clutch spring 104 is set to a value sufficient to wind the ink ribbon 22 of the wide tape cassette 10B.

In addition, the spool spring 94 in the wide tape cassette 10B is used to prevent the ribbon winding spool 30b from rotating due to vibration or the like and has a small frictional load. On the other hand, the spool spring 94 of the narrow tape cassette 10A has a large frictional force.

The spool spring 94 produces a frictional torque to the ribbon winding spool 30. The frictional torque between the spool spring 94 and the ribbon winding spool 30 is produced against the torque produced between the clutch spring 104 and the ribbon winding spool 30 so as to reduce a winding torque of the ink ribbon 22. As a result, even a narrow ink ribbon can be normally wound without being cut off. Therefore, tape cassettes respectively having a plurality of widths can be used in a single printing device without any problem.

As apparent from the above description, the cassette mounting structure in the printing device of the present invention enables tape cassettes respectively including a wide tape cassette and narrow tape cassette to be mounted and used.

In this case, since the narrow tape cassette is mounted on the outer side of the cassette accommodation unit, it can be easily attached/detached, and further, when the tape cassette is mounted, there is a less chance that the tape cassette causes an ink ribbon to be caught by a print head and damaged and the surface of the print head is stained.

Moreover, when a tape width, tape color, amount of a remaining tape of a tape cassette etc. are confirmed through the sight window of a cassette cover covering the cassette accommodation unit, they can be easily confirmed because the narrow tape cassette is mounted near cassette cover. Thus, the tape cassette mounting structure provides various advantages and is very convenient for use.

What is claimed is:

1. In combination, a printing device formed with a cassette accommodation chamber and a cassette positioned within said accommodation chamber, said cassette being one of a plurality of cassettes of predetermined thicknesses accommodating therein tapes of predetermined widths, respectively, for printing;

said printing device comprising:

a bottom surface of said accommodation chamber, an entrance to said accommodation chamber opposite to said bottom surface, cassette receiving means provided in said accommodation chamber for receiving a selected one of said cassettes of any one of said predetermined thicknesses, and cassette mounting means within said cassette receiving means for mounting said selected cassette; and said cassette having means thereon for cooperating with said mounting means so that a top surface of said selected cassette, opposite to a surface in confronting relationship with said accommodation chamber bottom surface, is at substantially the same position regardless of which one of said plurality of cassettes of predetermined thickness is selected.

2. The invention according to claim 1, wherein said cassette is formed to have a stepped portion at its lower side portion, and wherein said chamber is formed to have a receiving stepped portion corresponding to said stepped portion of said cassette.

3. The invention according to claim 2, wherein said cassette receiving means comprises a pole member on said bottom surface, said pole member projecting toward said entrance opening, whereby a relatively thin cassette of said plurality of cassettes of predetermined thicknesses is supported in said accommodation chamber by the engagement of said stepped portion with said receiving stepped portion, and by said pole member.

4. The invention according to claim 3, wherein said receiving stepped portion is disposed on one side of said accommodation chamber and wherein said pole member is disposed on a side of said accommodation chamber opposite said one side.

5. The invention according to claim 3, wherein, when said selected cassette is the most thin cassette of said plurality of predetermined thicknesses of cassettes and is supported in said accommodation chamber, the bottom surface of said most thin cassette rests on a top surface of said pole member.

6. The invention according to claim 5, wherein a portion corresponding to said pole member of the bottom of a cassette, which is thicker than said most thin cassette, is formed to be raised with respect to other portions of the bottom surface of said cassette so that said cassette is away from said bottom surface of said accommodation chamber in accordance with the thickness of said cassette.

7. In combination, a printing device formed with a cassette accommodation chamber and a cassette positioned within said accommodation chamber, said cassette being one of a plurality of cassettes of predetermined thicknesses accommodating therein tapes of predetermined widths, respectively, for printing;

said printing device comprising:

a bottom surface of said accommodation chamber, an entrance to said accommodation chamber opposite to said bottom surface, cassette receiving means provided in said accommodation chamber for receiving a selected one of said cassettes of any one of said predetermined thicknesses, cassette mounting means within said cassette receiving means for mounting said selected cassette, and a head member protruding upwardly from the bottom of said accommodation chamber, a portion of said head member being located within said cassette; and said cassette having means thereon for cooperating with said mounting means so that said head member portion underlies a top surface of said selected cassette, opposite to a surface in confronting relationship with said accommodation chamber bottom surface, regardless of which one of said plurality of cassettes of predetermined thickness is selected.

8. The invention according to claim 7, wherein said cassette is formed to have a stepped portion at its lower side portion, and wherein said chamber is formed to have a receiving stepped portion corresponding to said stepped portion of said cassette.

9. The invention according to claim 8, wherein said cassette receiving means comprises a pole member on said bottom surface, said pole member projecting toward said entrance opening, whereby a relatively thin cassette of said plurality of cassettes of predetermined thicknesses is supported in said accommodation chamber by the engagement of said stepped portion with said receiving stepped portion, and by said pole member.

10. The invention according to claim 9 wherein said receiving stepped portion is disposed on one side of said accommodation chamber and wherein said pole member is disposed on a side of said accommodation chamber opposite said one side.

11. The invention according to claim 9, wherein, when said selected cassette is the most thin cassette of said plurality of predetermined thicknesses of cassettes and is supported in said accommodation chamber, the bottom surface of said most thin cassette rests on a top surface of said pole member.

12. The invention according to claim 11, wherein a portion corresponding to said pole member of the bottom of a cassette, which is thicker than said most thin cassette, is formed to be raised with respect to the other portion of the bottom surface of said cassette so as to keep said head member underlying said surface of said cassette opposite to the surface facing the bottom surface of said accommodation chamber.

13. The invention according to claim 7, wherein said tape comprises a thermal ink ribbon, and wherein said head member comprises a thermal head.

* * * * *